United States Patent [19]

Nakada

[11] 4,432,266

[45] Feb. 21, 1984

[54] AUTOMATIC MUSICAL PERFORMANCE DEVICE CAPABLE OF CONTROLLING THE TEMPO

[75] Inventor: Akira Nakada, Hamamatsu, Japan

[73] Assignee: Nippon Gakki Seizo Kabushiki Kaisha, Shizuoka, Japan

[21] Appl. No.: 394,624

[22] Filed: Jul. 2, 1982

[30] Foreign Application Priority Data

Jul. 6, 1981 [JP] Japan ..... 56-105273

[51] Int. Cl.[3] ..... G10H 1/42

[52] U.S. Cl. ..... 84/1.03; 84/DIG. 12; 84/478

[58] Field of Search ..... 84/1.03, 478, DIG. 12

[56] References Cited

U.S. PATENT DOCUMENTS 4,344,344 8/1982 Nakada et al. ..... 84/1.03

4,345,501 8/1982 Nakada et al. ..... 84/1.03

*Primary Examiner*—S. J. Witkowski

*Attorney, Agent, or Firm*—Koda and Androlia

[57] ABSTRACT

An automatic musical performance device follows in tempo a manual performance and is controllable to change the tempo of automatic performance independently of the tempo of manual performance. The automatic musical performance device comprises means for generating reference tempo data, means for generating tempo return instruction and tempo control means for controlling the tempo of automatic performance so as to usually follow up the tempo of manual performance and for controlling the tempo of automatic performance in accordance with the reference tempo when the tempo return instruction signal is generated. The reference tempo data and the tempo return instruction can be generated by either one of record means and manual set means.

6 Claims, 7 Drawing Figures

AUTOMATIC MUSICAL PERFORMANCE DEVICE CAPABLE OF CONTROLLING THE TEMPO

BACKGROUND OF THE INVENTION

1. Field of the Invention

This invention relates to an automatic musical performance device which is suitably used for the practice by an amateur. More particularly, the present invention relates to an automatic musical performance device which enables tempo control of automatic performance irrespective of the tempo of manual performance.

2. Prior Art

A number of automatic musical performance devices have been known and proposed. In the conventional type of automatic musical performance devices proposed so far, the pitch data and the note length data for each note in progression of a series of notes are stored in a memory unit, and based on the pitch and note length data read out successively from the memory unit, a musical tone is produced or the key-press position is indicated.

In the automatic musical performance devices of the above-mentioned type, it has already been proposed to control the tempo of automatic performance by following up the tempo of manual performance by the key-press operation on the keyboard.

In accordance with the conventional tempo follow control system, however, the tempo of automatic performance is controlled in such a fashion as to always follow up the tempo of manual performance and it has not been possible to arbitrarily return it to a reference or standard tempo. The tempo, however, is desirable to be rapidly returned to the reference tempo depending upon contents of music and such a need frequently occurs especially in an interlude or a short movement during a musical composition. In the conventional tempo follow control system, however, the tempo of automatic performance can not be returned to the reference tempo unless the tempo of manual performance is carried out by the reference tempo, and such a tempo change can be made only slowly but not rapidly.

SUMMARY OF THE INVENTION

It is therefore an object of the present invention to provide a novel automatic musical performance device capable of arbitrarily restoring a reference tempo of automatic performance irrespective of the tempo of manual performance.

More particularly, an object of the invention is to provide an automatic performance device in which the automatic performance tempo generally follows the manual performance and is selectively restored to a reference tempo irrespective of the manual tempo.

It is one of the characterizing features of the automatic musical performance device in accordance with the present invention that the device includes means for generating reference tempo data and means for generating a tempo return instruction signal and when the tempo return instruction signal is not generated, the manual-tempo follow control is effected but once the tempo return instruction signal is generated, the tempo of automatic performance is decided on the basis of the reference tempo data.

In accordance with the present invention, it is possible to arbitrarily select whether the tempo of automatic performance is to follow up the tempo of manual performance or to be brought into conformity with the reference tempo. Hence, tempo control can be effectively made at the time of an interlude or the like when the tempo must be rapidly returned to the original reference tempo, and practice can be changed over to the one that is in harmony with the reference tempo with an arbitrary timing.

BRIEF DESCRIPTION OF THE DRAWINGS

The above and other objects, features and advantages of the present invention will become more apparent with reference to the following description taken in conjunction with the accompanying drawings, in which.

DETAILED DESCRIPTION OF THE INVENTION

Figure 1:
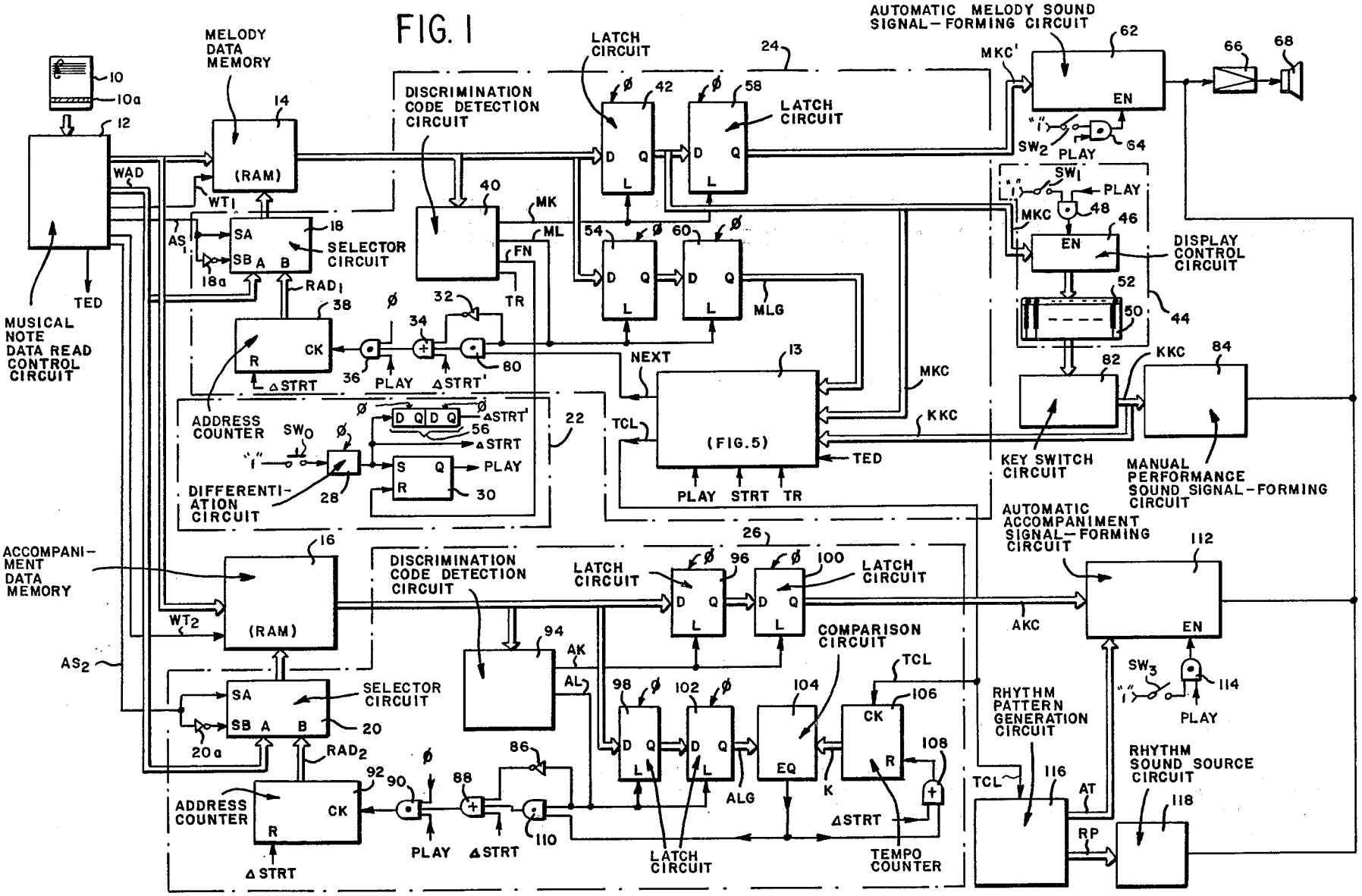
FIG. 1 is a block diagram of an electronic musical instrument having the automatic musical performance device in accordance with the present invention.

Referring initially to FIG. 1, a recording medium 10*a* such as a magnetic recording tape or the like is shown bonded to the lower blank portion of a music sheet 10 and stores therein musical note data corresponding to the content of the musical note and tempo data representing the reference tempo.

A musical note data read control circuit 12 reads the musical note data as well as the tempo data from the recording medium 10*a* and supplies the tempo data TED to a tempo control circuit 13. Furthermore, this circuit 12 transfers the melody data and accompaniment data of the musical note data to a melody data memory 14 and to an accompaniment data memory 16, respectively, and lets these memories 14, 16 to store the respective data. To control these transfer and memory operation, a write address signal WAD, write instruction signals $WT_1$, $WT_2$ and address selection signals $AS_1$, $AS_2$ are also delivered from this circuit. Each memory 14, 16 consists of a random access memory (RAM) and receives an address signal from the corresponding selector circuit 18, 20. The selector circuits 18 and 20 operate selectively in accordance with the address selection signals $AS_1$ and $AS_2$. In the selector circuit 18, an input A is selected with the control input SA being the logic "1" when the selection signal $AS_1$ is the logic "1" and an input B is selected with the control input SA being "1" by an inverter 18*a* when the selection signal $AS_1$ is the logic "0". In the selector circuit 20, on the other hand, the input A is selected with the control input SA being the logic "1" when the selection signal $AS_2$ is the logic "1" and the input B is selected with the control input SB being the logic "1" by an inverter 20*a* when the selection signal $AS_2$ is the logic "0".

Figure 2:
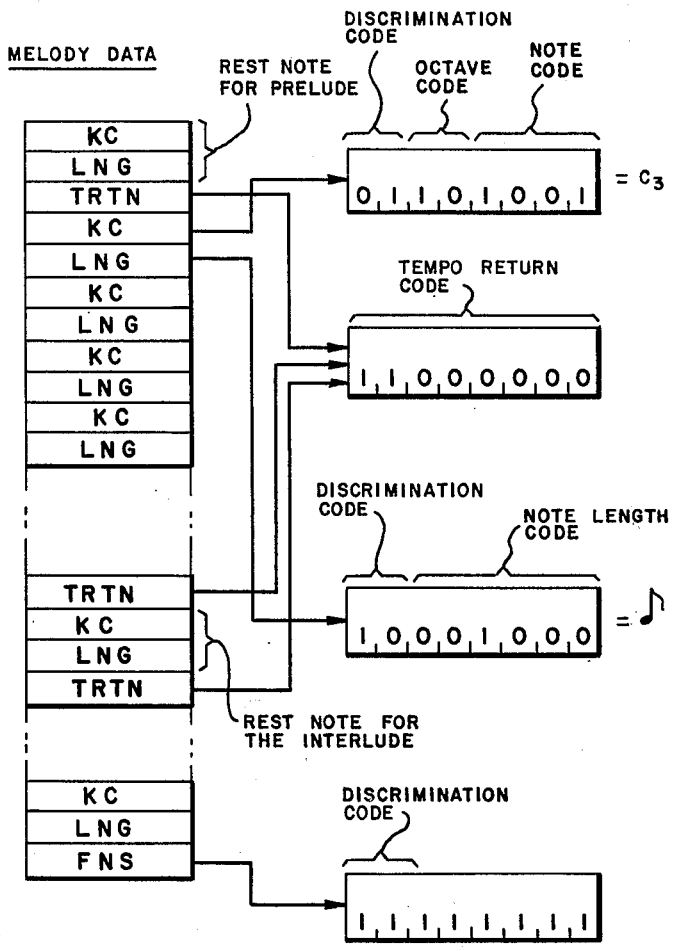
FIGS. 2 and 3 are formats of the melody data and accompaniment data to be employed in the electronic musical instrument shown in FIG. 1, respectively.

When the music sheet 10 is inserted into and set to a port of a data reader contained in the musical note data read control circuit 12 and the data read operation is started, the memory 14 is in the write mode in accordance with the write instruction signal $WT_1$ and the write address signal WAD is supplied to the memory 14 from the selector circuit 18 which is under the state for selecting the input A in accordance with the selection signal $AS_1$. Accordingly, the melody data are written into the memory 14 in response to the melody progress of the music sheet 10 in the format such as shown in FIG. 2. The melody data written in this case represent the melody sound to be generated by the combination of an 8-bit key code KC with an 8-bit length code LNG. As exemplified by the tone $C_3$, the upper two bits of each key code form a discrimination code, the next two bits form an octave code and the remaining four bits form a note code. As exemplified by an eighth note, the upper two bits of each length code LNG form a discrimination code and the remaining six bits form a tone length code.

A rest note is represented by the key code KC when all the six bits other than its discrimination code bits are the logic "0". In FIG. 2, one data corresponding to the rest note for a prelude or an opening movement and one data corresponding to an interlude are shown as the rest note data. If the rest time for the prelude and the interlude is long, a plurality of rest data may be disposed.

Tempo return codes TRTN are disposed at suitable positions in the melody progress and these codes are also written into the memory 14. The upper two bits of each tempo return code form the logic "1" with the rest of six bits forming the logic "0". In order to return the automatic performance tempo, that is following up the manual performance tempo, to the reference tempo, the tempo return code is generally disposed before the data corresponding to the rest note for the interlude. In the embodiment shown in FIG. 2, however, the tempo return codes TRTN are disposed after the data corresponding to the rest note for the prelude as well as after the data corresponding to the rest note for the interlude in order to ensure reliable operation.

The end code FNS is disposed after the end of a series of melody, and writing to the memory 14 is finished when this end code FNS is written. Of the end code FNS, the upper two bits are the logic "1" and form the discrimination code and all the remaining six bits are the logic "1".

Figure 3:
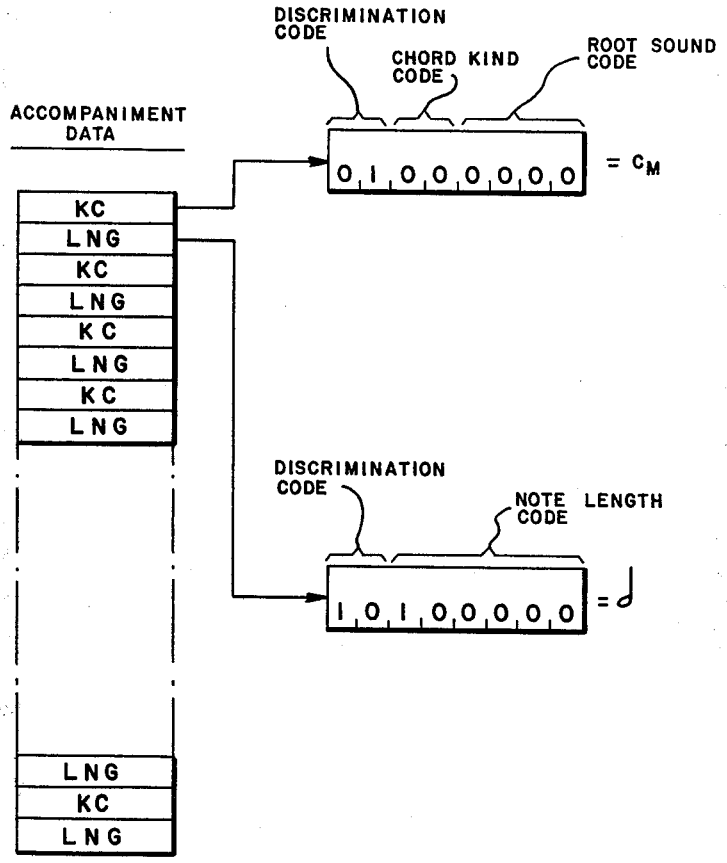

After writing of the end code FNS is finished, the memory 16 changes to the write mode in accordance with the write instruction signal $WT_2$ and the write address signal WAD is supplied to the memory 16 from the selector circuit 20 which is under the state for selecting the input A in accordance with the selection signal $AS_2$. Accordingly, the accompaniment data corresponding to the progress of accompaniment (chord or bass sound) of the music sheet 10 are written in the format shown in FIG. 3. The accompaniment data written in this instance represent the chord to be generated by the combination of the 8-bit key code KC with the 8-bit length code LNG. As exemplified by the C major ($C_M$), the upper two bits of each key code form a discrimination code, the next two bits form a chord kind code and the remaining four bits from a root sound code. Here, the chord kind codes are arranged such that the major is expressed by the logic "00", the minor, by the logic "01" and the seventh, by the logic "10". As exemplified by the half note, the upper two bits of each code LNG form the discrimination and the remaining six bits form the note length code.

After the series of data read and write operation described above, the start switch $SW_O$ of the start-stop control circuit 22 is turned on, thereby actuating the melody data read circuit 24 and the accompaniment data read circuit 26. Namely, when the start switch $SW_O$ is turned on, its ON signal rises and is differentiated by a differentiation circuit 28 in synchronism with the system clock signal $\phi$ and is changed into a start signal ΔSTRT. Since this start signal ΔSTRT sets an R-S flip-flop 30, a play mode signal PLAY consisting of its output Q="1" is delivered from the flip-flop 30. In this case, the input signal of an inverter 32 is the logic "0" so that the output signal "1" of the inverter 32 is supplied to an AND gate 36 through an OR gate 34. Hence, when the play mode signal PLAY="1" is generated, the AND gate 36 becomes conductive and supplies the clock signal $\phi$ to an address counter 38.

When reset by the start signal ΔSTRT, the address counter 38 supplies, as the input B, a read address signal $RAD_1$ corresponding to the first read address to the selector circuit 18. In this case, the selector circuit 18 is under the state for selecting the input B because the selection signal $AS_1$="0", and supplies the read address signal $RAD_1$ corresponding to the first read address to the memory 14. Consequently, the key code data corresponding to the rest note for the prelude are read out from the memory 14. The discrimination code signal consisting of the upper two bits is left in a discrimination code detection circuit 40 while the signal consisting of the remaining six bits is supplied to a latch circuit 42 that is timed by the clock signal $\phi$.

The discrimination code detection circuit 40 generates the key code detection signal MK in response to the first key code data from the memory 14 and the latch circuit 42 latches the key code signal corresponding to the rest note for the prelude in accordance with this key code detection signal MK. The key code signal MKC latched by the latch circuit 42 is supplied to a display portion 44. The key code signal MKC in this case corresponds to the rest note for the prelude and its all bits are the logic "0". Hence, key-press indication is not indicated in the display portion 44.

Therefore, when the counter 38 counts one pulse of the clock signal $\phi$, the length code data corresponding to the rest note for the prelude are read out from the memory 14 in the same way as before. Of the read data in this case, the discrimination code signal of the upper two bits is supplied to the discrimination code detection circuit 40 and the note length code signal of the remaining 6 bits is supplied to the latch circuit 54 that is timed by the clock signal $\phi$. Since the discrimination code detection circuit 40 generates a length code detection signal ML in accordance with the first length code data, the latch circuit 54 latches the note length code signal corresponding to the rest note for the prelude in accordance with the length code detection signal ML. The length code detection signal ML in this case is supplied to the inverter 32 so that the output signal of the inverter 32 becomes "0" and the counting operation of the counter 38 is once stopped.

Next, when a point is reached which is behind of the timing of occurrence of the start signal ΔSTRT by about two-bit time of the clock signal $\phi$, a two-stage D-flip-flop 56, that is time by the clock signal $\phi$, generates a re-start signal ΔSTRT'. This re-start signal ΔSTRT' renders conductive the AND gate 36 via the OR gate 34, the counter 38 again counts the clock signals $\phi$ from the AND gate 36. Accordingly, the tempo return code data are read out from the memory 14 in accordance therewith, the discrimination code detection circuit 40 supplies the tempo return code detection signal TR to the tempo control circuit 13 so that the tempo clock signal TCL from the tempo control circuit 13 comes to reliably have a frequency corresponding to the reference tempo. In succession to the read of the tempo return code data, the key code data and length code data corresponding to the first melody sound are sequentially read out from the memory 14, and the discrimination code detection circuit 40 sequentially generates the key code detection signal MK as well as the length code detection signal ML in response to the former. In this case, the key code detection signal MK transfers a key code signal corresponding to the rest note for the prelude from the latch circuit 42 to a latch circuit 58 similar to the former (42) and lets the latch circuit 42 to latch the first melody key code signal. In this case, too, the length code detection signal ML transfers a note code signal corresponding to the rest note for the prelude from the latch circuit 54 to a latch circuit 60 similar to the former (54) and lets the latch circuit 54 to latch the first melody note length code signal and further stops temporarily the counting operation of the counter 38 via the inverter 32 in the same way as before.

Since the melody key code signal MKC corresponding to the first melody sound from the latch circuit 42 is supplied to the display portion 44, key-press indication corresponding to the first melody sound is effected in the display portion 44.

In the display portion 44 is disposed a display control circuit 46 which receives the melody key code signal MKC as its input. When an enable signal EN is supplied to this display control circuit 46 in response to making of the display select switch $SW_1$ from the AND gate 48 which is conductive by the play mode signal PLAY, the control circuit 46 selectively lights a specified light-emitting element of a group of light-emitting elements 52 disposed along the key arrangement of a keyboard 50 so as to visually display the key which is to be pressed. If the first melody key code signal represents the tone $C_3$ as in the example shown in FIG. 2, for example, the light-emitting element corresponding to the key $C_3$ is lit, thereby indicating key-press. In this case, the key code signal MKC' is supplied from the latch circuit 58 to an automatic melody sound signal-forming circuit 62 but since all the bits of this signal MKC' are the logic "0" in response to the rest note for the prelude, automatic performance of the melody sound is not effected.

On the other hand, the note length code signal MLG corresponding to the rest note for the prelude from the latch circuit 60 is supplied to the tempo control circuit 13. As will be explained later with reference to FIG. 5, the tempo control circuit 13 generates the tempo clock signal TCL and the read control signal NEXT on the basis of the note length code signal MLG, the key code signal MKC, the key code signal KKC on key-press, the tempo data TED, the tempo return code detection signal TR, the play mode signal PLAY and the start signal ΔSTRT. It generates the first read control signal NEXT when a key is pressed in such a fashion that the key code of the signal MKC and that the KKC relating to the first melody sound coincide with each other, after the note length code signal MLG corresponding to the rest note for the prelude is supplied from the latch circuit 60. In this case, the read control signal NEXT is supplied to the AND gate 36 via the OR gate 34 from an AND gate 80 that is rendered conductive by the length code detection signal ML. Hence, the counter 38 again starts counting the clock signals $\phi$ from the AND gate 36. Accordingly, the key code data and length code data corresponding to the second melody sound are sequentially read out from the memory 14 so that the first and second melody key code signals are latched in the latch circuits 58 and 42, respectively, while the first and second melody note length code signals are latched in the latch circuits 60 and 54, respectively.

The melody key code signal MKC' corresponding to the first melody sound from the latch circuit 58 is supplied in this case to the automatic melody sound signal-forming circuit 62. When the enable signal EN is supplied to the circuit 62 from the AND gate 64, that is rendered conductive by the play mode signal PLAY, in response to making of the sound generation select switch $SW_2$, the circuit 62 electronically forms a melody sound signal in response to the melody key code signal MKC' and supplies it to a speaker 68 via an output amplifier 66. Hence, the first melody sound is generated from the speaker 68 with a slight delay with respect to the first key-press indication. In the automatic melody sound signal-forming circuit 62, the melody sound signal corresponding to the first melody sound is generated; key-press indication corresponding to the second melody sound is effected in the display portion 44; and the operation for generating the second read control signal NEXT is carried out in the tempo control circuit 13. When these operations are thereafter repeated, sound generation of the melody sound of the second and so forth and key-press indication prior to the sound generation of each melody sound are automatically carried out.

During the process of automatic key-press indication and automatic melody performance, the automatic performance tempo or the frequency of the tempo clock signal TCL is controlled so as to follow up the tempo of manual performance as will be later described. Immediately before the interlude is to be interposed, the discrimination code detection circuit 40 supplies the tempo return code detection signal TR to the tempo control circuit 13 in response to reading of the tempo return code data from the memory 14 so that the frequency of the tempo clock signal TCL or the automatic performance tempo is decided in accordance with the reference tempo. When the interlude is finished, the tempo return code data are again read out from the memory 14 so that the subsequent automatic performance is reliably started again in response to the reference tempo.

Finally, the end code data are read out from the memory 14 and the discrimination code detection circuit 40 generates the end code detection signal FN in response thereto. Since this end code detection signal FN resets the flip-flop 30, the play mode signal PLAY becomes the logic "0" and a series of data read-out from the memory 14 is finished.

The key switch circuit 82 include a large number of key switches operative in the interlocking arrangement with a large number of keys of a keyboard 50, and supplies a key code signal KKC representative of the pressed key to the aforementioned tempo control circuit 13. The manual performance sound signal-forming circuit 84 electronically generates a melody sound signal corresponding to the pressed key in response to the key code signal KKC from the key switch circuit 82 and supplies it to the speaker 68 via the output amplifier 66. Hence, the speaker 68 emits also the melody sound due to the manual performance.

Manual exercise can be effectively practised in this case on the keyboard 50 by while listening to the aforementioned automatic performance sound and/or looking at the automatic key-press indication by the group of light-emitting elements 52. In practising the exercise, it is also possible to utilize the automatic accompaniment by the later-appearing chord and bass sound and/or the automatic rhythm accompaniment.

In the accompaniment data read circuit 26, the input signal of the inverter 86 is the logic "0" when the aforementioned start switch $SW_0$ is kept ON so that the output signal "1" of the inverter 86 is supplied to the AND gate 90 through the OR gate 88. Accordingly, when the start switch $SW_0$ is turned on and the play mode signal PLAY="1" is generated, the clock signal $\phi$ is supplied from the AND gate 90 to the address counter 92.

When reset by the start signal ΔSTRT, the address counter 92 supplies the read address signal $RAD_2$ corresponding to the first read address to the selector circuit 20 as the input B. In this case, the selector circuit 20 is brought under the state for selecting the input B by the selection signal $AS_2$="0" and supplies the read address to the accompaniment data memory 16. Hence, the key code data corresponding to the first accompaniment sound are read out from the memory 16 and the discrimination code signal of its upper two bits is left in the discrimination code detection circuit 94 while the accompaniment key code (chord kind code and root sound code) signal of the remaining six bits is supplied to a latch circuit 96 that is timed by the clock signal $\phi$.

The discrimination code detection circuit 94 generates the key code detection signal AK in response to the first key code data from the memory 16 and the latch circuit 96 latches the first accompaniment key code signal in response to this key code detection signal AK.

When the counter 92 thereafter counts one pulse of the clock signal $\phi$, the length code data corresponding to the first accompaniment sound are read out from the memory 16 in the same way as before. Of the read data in this case, the discrimination code signal consisting of the upper two bits is supplied to the discrimination code detection circuit 94 and the accompaniment note length code signal consisting of the remaining six bits is supplied to the latch circuit 98 that is timed by the clock signal $\phi$. Since the discrimination code detection circuit 94 generates a length code detection signal AL in response to the first length code data from the memory 16, the latch circuit 98 latches the first accompaniment note length code signal in response to the length code detection signal AL. The length code detection signal AL is also supplied to the inverter 86 in this case. Hence, the output signal of the inverter 86 becomes "0" and renders nonconductive and AND gate 90 through the OR gate 88, and the counting operation of the counter 92 is temporarily stopped.

Thereafter, the aforementioned re-start signal ΔSTRT renders the AND gate 90 conductive through the OR gate 88 so that the counter 92 counts again the clock signals $\phi$ from the AND gate 90. Consequently, the key code data and length code data corresponding to the second accompaniment sound are sequentially read out from the memory 16 and in response thereto, the discrimination code detection circuit 94 generates sequentially the key code detection signal AK and the length code detection signal AL. The key code detection signal AK in this case transfers the first accompaniment key code signal from the latch circuit 96 to a latch circuit 100 similar to the former (96) and lets the latch circuit 96 to latch the second accompaniment key code signal. The length detection signal AL in this case transfers the first accompaniment note length code signal from the latch circuit 98 to a latch circuit 102 similar to the former (98) and lets the latch circuit 98 to latch the second accompaniment note length code signal and stops temporarily the counting operation of the counter 92 via the inverter 86 in the same way as before.

As a result of the abovementioned operation, the latch circuit 100 delivers the accompaniment key code signal AKC corresponding to the first accompaniment sound while the latch circuit 102 delivers the accompaniment note length code signal ALG corresponding to the first accompaniment sound. The accompaniment note length code signal ALG corresponding to the first accompaniment sound is supplied to a comparison circuit 104, where it is compared with the counted output K of a tempo counter 106. Since the tempo counter 106 is constructed such that it counts the tempo clock signals TCL from the tempo control circuit 13 after being reset by the start signal ΔSTRT from an OR gate 108, the comparison circuit 104 generates a coincidence signal EQ when the counted value of the counter 106 reaches a value corresponding to the note length represented by the first accompaniment note length code signal.

Since the coincidence signal EQ in this instance resets the counter 106 via the OR gate 108, the counter 106 again counts the tempo clock signal TCL after being reset. The coincidence signal EQ is supplied to the AND gate 90 via the OR gate 88 from an AND gate 110 that is rendered conductive by the length code detection signal AL and consequently, the counter 92 again starts counting the clock signals $\phi$ from the AND gate 90. Hence, the key code data and length code data corresponding to the third accompaniment sound are sequentially read out from the memory 16 and the second and third accompaniment key code signals are latched in the latch circuits 100 and 96, respectively, while the second and third accompaniment note length code signals are latched in the latch circuits 102 and 98, respectively. Then, the accompaniment key code signal AKC corresponding to the second accompaniment sound is delivered from the latch circuit 100 and the accompaniment note length code signal ALG corresponding to the second accompaniment sound is delivered from the latch circuit 102. The comparison circuit 104 measures the note length relating to the second accompaniment sound. These operations are thereafter repeated so that the accompaniment data are sequentially read out from the memory 16 and the accompaniment key code signals AKC are sequentially delivered from the latch circuit 100. Data read-out from the memory 16 finishes before the end data is read out from the memory 14.

The accompaniment key code signal AKC delivered from the accompaniment data read circuit 26 in the abovementioned manner is supplied to the automatic accompaniment sound signal-forming circuit 112. When the enable signal EN is supplied to this circuit 112 in response to making of the sound generation select switch $SW_3$ from the AND gate 114 which is rendered conductive by the play mode signal PLAY, the circuit 112 electronically forms the accompaniment sound signal on the basis of the accompaniment key code signal AKC and the rhythm selection data not shown. As the accompaniment sound signal, the circuit 112 generates a chord signal corresponding to a plurality of chord-forming sounds and a bass sound signal in match with the chord and rhythm to be generated. The timing of delivery of the individual accompaniment sound signal from the automatic accompaniment sound signal-forming circuit 112 is controlled in the interlocking arrangement with the rhythm in accordance with the accompaniment timing signal AT from the rhythm pattern generation circuit 116, and the accompaniment sound signal from the circuit 112 is supplied to the speaker 68 through the output amplifier 66. Accordingly, the speaker 68 emits also the automatic accompaniment sound.

Besides the abovementioned accompaniment timing signal AT, the rhythm pattern generation circuit 116 generates a rhythm pattern signal RP in response to the tempo clock signal TCL from the tempo control circuit 13 and this rhythm pattern signal RP is supplied to a rhythm sound source circuit 118. The rhythm sound source circuit 118 actuates a suitable rhythm sound source in response to the rhythm pattern signal RP and generates the rhythm sound signal and this rhythm sound signal is also supplied to the speaker 68 through the output amplifier 66. Accordingly, the automatic rhythm sound is also emitted from the speaker 68.

Figure 4:
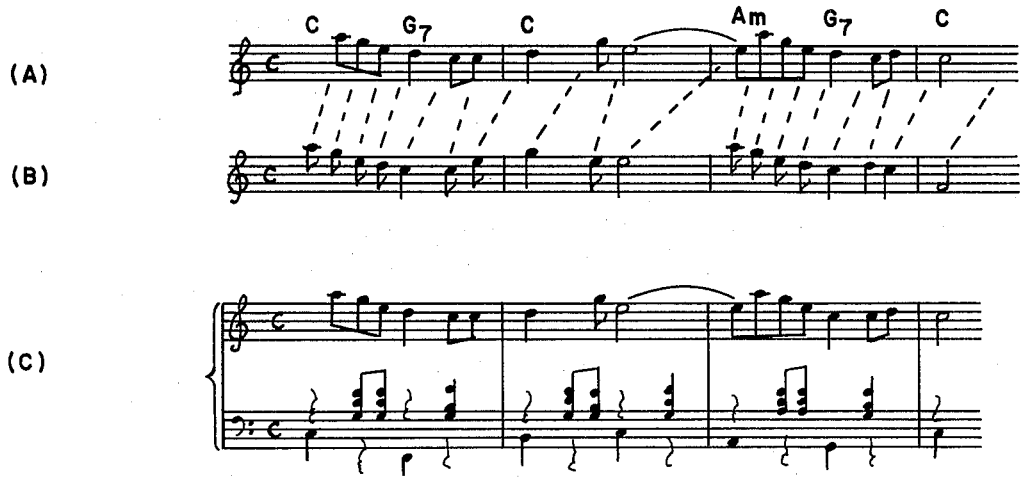
FIGS. 4(A) through 4(C) shows the musical notes useful for explaining the display and performance operations of the electronic musical instrument of FIG. 1.

FIG. 4 shows an example of the display and performance operations of the abovementioned electronic musical instrument, in which (A) shows the note progress of the musical note, (B) shows the timing of the key-press indication and (c) shows the automatic performance timing of the melody and accompaniment. It can be understood well from FIG. 4 that the key-press indication of each melody sound of the second sound and so forth goes ahead of the timing of the sound generation of the corresponding melody sound by the time corresponding to the length of the preceding note. For simplicity, the rest note for the prelude and the operation associated therewith are deleted from FIG. 4.

Figure 5:
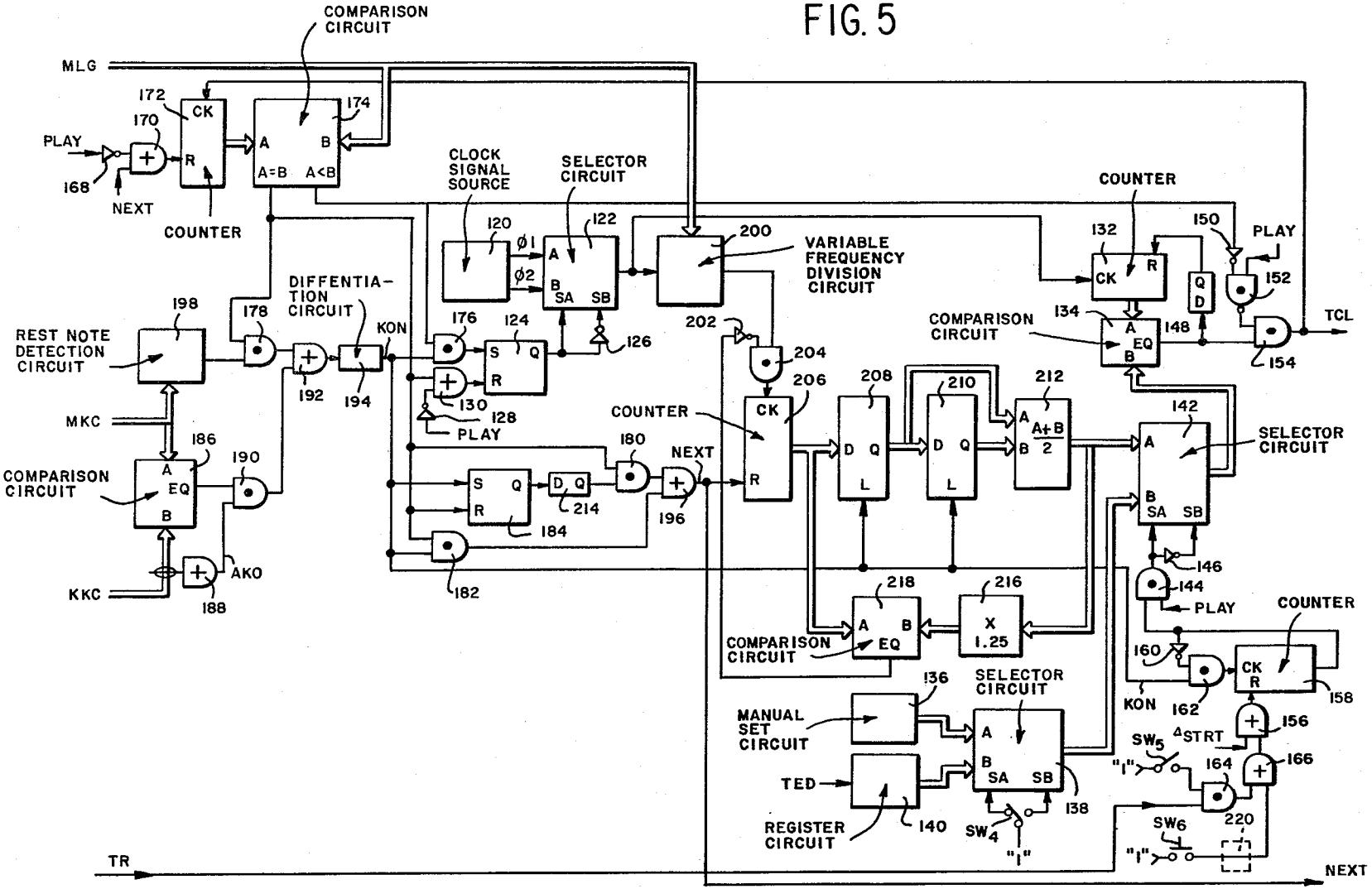
FIG. 5 is a detailed circuit diagram of the tempo control circuit of the electronic musical instrument of FIG. 1.

FIG. 5 is a circuit diagram showing in detail the construction of the tempo control circuit 13.

A clock signal source 120 generates a first clock signal $\phi_1$ having a relatively high frequency and a second clock signal $\phi_2$ having a relatively low frequency, and the frequency of the first clock signal $\phi_1$ is higher by several times than that of the second clock signal $\phi_2$, for example. The first and second clock signal $\phi_1$ and $\phi_2$ are supplied to the selector circuit 122 as the input A and B, respectively. The output Q of an R-S flip-flop 124 is supplied as the selection signal SA for selecting the input A to the selector circuit 122 while a signal obtained by inverting the output Q of a flip-flop by an inverter 126 is supplied as the selection signal SB for selecting the input B to the circuit 122.

Before the start signal ΔSTRT is generated, the play mode signal PLAY resets the flip-flop 124 through an inverter 128 and through an OR gate 130 and hence, the output Q of the flip-flop 124 is the logic "0". The selector circuit 122 selects the second clock signal $\phi_2$ in accordance with the selection signal SB="1" formed by inverting this output Q="0" by the inverter 126 and supplies it to the counter 132. The counter 132 counts the second clock signals $\phi_2$ and supplies its counted output to a comparison circuit 134 as one of the comparison input A.

A manual set circuit 136 is disposed so as to suitably and manually set the reference tempo and to supply the tempo data corresponding to the set reference tempo to a selector circuit 138 as the input A. A register circuit 140 stores the tempo data TED corresponding to the reference tempo supplied in the form of serial data from the musical note read control circuit 12 and supplies the tempo data TED in the form of the parallel data to a selector circuit 138 as the input B. On the basis of the operation of a select switch $SW_4$, the selector circuit 138 selects and delivers the tempo data from the manual set circuit 136 when the selection signal SA is the logic "1" and selects and delivers the tempo data from the register circuit 140 when the selection signal SB is the logic "1".

The tempo data from the selector circuit 138 are supplied to a selector circuit 142 as the input B. Before the start signal ΔSTRT is generated, the AND gate 144 generates the output signal "0" in response to the play mode signal PLAY="0", and an inverter 146 that receives this output signal "0" as its input supplies the selection signal SB="1" for selecting the input B to the selector circuit 142. Accordingly, the selector circuit 142 selects the tempo data corresponding to the reference tempo from the selector circuit 138 and supplies it to a comparison circuit 134 as the other of the comparison input B.

The comparison circuit 134 compares the comparison input A with B and generates a coincidence signal EQ when they coincide with each other. This coincidence signal EQ resets the counter 132 via a D-flip-flop 148 and hence, the counter 132 again counts thereafter the second clock signals $\phi_2$ after being reset. The same procedures are thereafter repeated and the coincidence signals EQ are repeatedly generated from the comparison circuit 134 with a period corresponding to the reference tempo.

Before the start signal ΔSTRT is generated, the output signal of the inverter 150 is "0" and the play mode signal PLAY is also "0". Accordingly, the output signal of a NAND gate 152 is "1" and an AND gate 154 is rendered conductive by the output signal "1" of the NAND gate 152. The coincidence signals EQ produced repeatedly from the comparison circuit 134 are therefore delivered as the tempo clock signals TCL via the AND gate 154. Since the tempo clock signal TCL in this case has the frequency corresponding to the reference tempo represented by the tempo data from the manual set circuit 136 or the register circuit 140, the abovementioned automatic rhythm sound is generated with a tempo corresponding to the reference tempo.

Next, when the start signal ΔSTRT is generated, the signal restes the counter 158 via an OR gate 156 so that the output signal "0" of the counter 158 renders conductive an AND gate 162 via an inverter 160. Hence, the AND gate 162 reaches a state in which it is capable of supplying a key-ON signal KON to the counter 158. The counter 158 is so constructed that it generates the output signal "1" when it counts three key-on signals KON.

If an automatic return select switch $SW_5$ is turned on beforehand, when the discrimination code detection circuit 40 generates the first tempo return code detection signal TR after the length code data corresponding to the rest note for the prelude are read out from the memory 14, this signal TR is supplied as the reset input to the counter 158 via the AND gate 164 and via the OR gates 166 and 156. Accordingly, even if the counter 158 has not been reset by the start signal ΔSTRT, it is reset in accordance with the first tempo return code detection signal TR. In consequence, the AND gate 144 keeps delivering the output signal="0" until the counter 158 makes the three counts even if the play mode signal PLAY becomes "1" in response to the start signal ΔSTRT, and the tempo clock signal TCL keeps the frequency corresponding to the reference tempo until the counter 158 makes the three counts.

When the play mode signal PLAY becomes the logic "1", this signal releases a counter 172 from resetting via the inverter 168 and the OR gate 170. The counter 172 therefore counts the tempo clock signals TCL and supplies its counted output to the comparison circuit 174 as one of the comparison output A. The first note length code signal MLG corresponding to the rest note for the prelude is supplied as the other comparison input B to the comparison circuit 174. The comparison circuit 174 compares the input A and B with each other, supplies the output signal "1" to the inverter 150 and to the AND gate 176 so long as A<B and supplies the output signal "1" to the OR gate 130, to the AND gates 178, 180 and 182 and to an R-S flip-flop 184 when A=B. When the output signal corresponding to A=B becomes "1", the output signal corresponding to A<B becomes "0" whereby the output signal of the NAND gate 152 becomes "0" and inhibits the delivery of the tempo clock signal TCL from the AND gate 154.

The timing at which the comparison circuit 174 generates the output signal corresponding to A=B corresponds to the timing at which key-press corresponding to the first melody sound is to be effected. The melody key code signal MKC corresponding to the first melody sound is supplied as one of the comparison input A to the comparison circuit 186 substantially simultaneously with the timing when the note length code signal MLG corresponding to the rest note for the prelude is supplied to the comparison circuit 174. Assuming that the key-press operation corresponding to the first melody sound is to be effected at the timing when the comparison circuit 174 generates the output signal corresponding to A=B, the key code signal KKC based on the key-press operation is supplied as the other comparison input B to the comparison circuit 186. Accordingly, the comparison circuit 186 compares the comparison input A with B and generates the coincidence signal EQ when the key codes coincide with each other. This coincidence signal EQ is supplied to a differentiation circuit 194 through an AND gate 190, that is rendered conductive by any-key-ON signal AKO from an OR gate 188 receiving the key code signal KKC as its input, and through an OR gate 192. The differentiation circuit 194 differentiates the input signal at its rise and generates the first key-ON signal KON. This key-ON signal is delivered as the first read control signal NEXT through the AND gate 182 that is rendered conductive by the output signal corresponding to A=B from the comparison circuit 174, and through the OR gate 196. The first read control signal NEXT resets the counter 172 through the OR gate 170 so that the counter 172 counts again the tempo clock signals TCL after being reset.

If the melody key code MKC corresponds to the rest note, a rest note detection circuit 198 generates a rest note detection signal and renders the AND gate 178 conductive. When the comparison circuit 174 generates the output signal corresponding to A=B, the output signal is supplied to the differentiation circuit 194 through the AND gate 178 and through the OR gate 192 so that the key-ON signal KON as well as the read control signal NEXT are generated in the same way as before.

On the other hand, the second clock signal $\phi_2$ delivered from the selector circuit 122 is supplied to a variable frequency division circuit 200 and is frequency-divided with a frequency division ratio corresponding to the length of the rest note for the prelude represented by the first note length code signal MLG. The frequency division output signal from the variable frequency division circuit 200 is supplied to a counter 206 through an AND gate 204 that is rendered conductive by the output signal "1" of an inverter 202 and is counted by a counter 206. The variable frequency division circuit 200 is disposed so that the counted value of the counter 206 becomes substantially equal to all the notes and the frequency division ratio becomes greater for a longer note. The counter 206 is reset by the first read control signal NEXT and the counted data immediately before resetting are latched in a latch circuit 208 in accordance with the first key-ON signal KON.

The first key-ON signal KON is supplied to the counter 158 through the AND gate 162 and the counter 158 counts up by one in accordance with the signal.

As described already, the first read control signal EXT permits the read-out of the melody data corresponding to the second melody sound from the memory 14 so that the note length code signal MLG corresponding to the first melody sound is supplied to the comparison circuit 174 while the key code signal MKC corresponding to the second melody sound is supplied to the comparison circuit 186. Assuming that the key-press operation corresponding to the second melody sound is effected almost at the same time when the comparison circuit 174 generates the output signal corresponding to A=B, the second key-ON signal KON and the second read control signal NEXT are generated in the same way as in the first key-press operation.

The second read control signal NEXT resets the counter 206 and the counted data immediately before resetting are latched in the latch circuit 208 in response to the second key-ON signal KON. The counted data corresponding to the first key-press operation that have been latched in the latch circuit 208 are transferred to the latch circuit 210 in response to the second key-ON signal KON and are latched there. Accordingly, an averaging circuit 212 receives the counted data corresponding to the first key-press operation from the latch circuit 210 and the counted data corresponding to the second key-press operation from the latch circuit 208 as the input A and B, respectively, performs the averaging processing (A+B)/2 and supplies the result to the selector circuit 142 as the input A.

Since the second key-ON signal KON is supplied to the counter 158 through the AND gate 162, the counter 158 performs the second count operation in response thereto.

The procedures described above with reference to the second key-press operation are followed in the same way for the third key-press operation. As a result, the averaging circuit 212 supplies the output data in the averaged form of the counted data corresponding to the second key-press operation and the counted data corresponding to the third key-press operation, to the selector circuit 142 as the input A. The counter 158 counts the third key-ON signal and generates the output signal "1". This output signal "1" renders non-conductive the AND gate 162 through the inverter 160, checks the subsequent key-ON signal while it is supplied to the selector circuit 142 via the AND gate 144 as the selection signal SA for selecting the input A.

Accordingly, the selector circuit 142 selects the tempo data from the averaging circuit 212 instead of the tempo data corresponding to the reference tempo from the selector circuit 138 and supplies it to the comparison circuit 134 as the input B. The frequency of the tempo clock signal TCL is therefore controlled in accordance with the averaged tempo data relating to the second third key-press operation.

In the case of coincidence key-press operation in which the timing of the third key-press operation substantially coincides with the end of the lasting period (note length) of the second melody sound, the frequency of the tempo clock signal TCL remains the same as that corresponding to the previous reference tempo. However, if the timing of the third key-press operation is somewhat earlier or belated, the frequency of the tempo clock signal TCL is variably controlled so as to follow up such advance or delay.

When the key-press operation is made earlier, the key-ON signal KON sets the flip-flop 124 through the AND gate 176 which is rendered conductive by the output signal "1" corresponding to $A<B$ from the comparison circuit 174. Hence, the selector circuit 122 selects the high speed first clock signal $\phi_1$ instead of the low speed second clock signal $\phi_2$ in accordance with the selection signal SA consisting of the output Q="1" from the flip-flop 124 and supplies it to the counter 132 and to the variable frequency division circuit 200, whereby the counting speed of the counter 132 becomes faster, the frequency of the tempo clock signal TCL becomes higher and along therewith, the counting speed of the tempo colck signal TCL also becomes faster. As the key-ON signal KON sets the flip-flop 184, the output Q="1" of the flip-flop 184 renders the AND gate 180 conductive through a D-flip-flop 214. Thereafter, when the comparison circuit 174 generates the output signal "1" corresponding to $A=B$, this output signal "1" is delivered as the read control signal NEXT through the AND gate 180 and through the OR gate 196. Incidentally, the output signal "1" corresponding to $A=B$ from the comparison circuit 174 resets the flip-flop 184.

The read control signal NEXT in this case resets the counter 206 and the counted data of this counter 206 are latched in the latch circuit 208 in accordance with the key-ON signal immediately before resetting, as described in the foregoing. The counted data latched in the latch circuit 208 in this case represent a smaller value than that in the coincidence key-press operation so that the output data from the averaging circuit 212 also represents a considerably faster tempo than the reference tempo. The output data from the averaging circuit 212 are supplied to the comparison circuit 134 through the selector circuit 142. For this reason, the frequency of the tempo clock signal TCL is changed and controlled in such a manner that the tempo of the automatic performance becomes faster so as to follow up the tempo of the manual performance.

In the case of the delayed key-press operation, when the output signal="1" corresponding to $A=B$ is generated from the comparison circuit 174, the tempo clock signal TCL, that has been generated on the basis of the low speed second clock signal $\phi_2$, is prevented from being delivered through the AND gate 154 so that the counter 172 stops the counting operation. Thereafter, when the key-ON signal KON is generated, this signal is delivered as the read control signal NEXT through the AND gate 182 that is rendered conductive by the output signal "1" corresponding to $A=B$ from the comparison circuit 174 and further through the OR gate 196. This read control signal NEXT resets the counter 206 and the counted data immediately before resetting are latched in the latch circuit 208 in response to the key-ON signal KON. Since the counted data latched in the latch circuit 208 represent a greater counted value than that in the coincidence key-press operation, the output data from the averaging circuit 212 also represent a considerably slower tempo than the reference tempo. The output data from the averaging circuit 212 are supplied to the comparison circuit 134 through the selector circuit 142. Consequently, the frequency of the tempo clock signal TCL is changed and controlled in such a manner that the tempo of the automatic performance is delayed so as to follow up the tempo of the manual performance.

If no key-press operation is effected even when the counted value of the counter 206 reaches a value 1.25 times the averaging value represented by the output data of the averaging circuit 212, a comparison circuit 218, that receives the counted data from the counter 206 as one of comparison input A and the output data from a multiplication circuit 216 multiplying the output data of the averaging circuit 212 by 1.25 as the other comparison input B, generates a coincidence signal EQ when both comparison input A and B coincide with each other. Since this coincidence signal EQ renders conductive the AND gate 204 through the inverter 202, the counted value of the counter 206 does not become greater than 1.25 times the average value represented by the output data of the averaging circuit 212.

The procedures described with reference to the third key-press operation are carried out in the same way for the fourth key-press operation and so forth. Immediately before the timing at which the interlude is interposed during these procedures, the discrimination code detection circuit 40 (FIG. 1) generates the tempo return code detection signal TR. Accordingly, if the switch $SW_5$ is kept on, the counter 158 is reset in accordance with this signal TR, and the selector circuit 142 supplies the tempo data corresponding to the reference data from the selector circuit 138 to the comparison circuit 134 so that the frequency of the tempo clock signal TCL is decided in accordance with the reference tempo. When the interlude is finished, the tempo return code detection signal TR is again supplied to the counter 158 as the reset input and hence, the tempo of the automatic performance immediately after the interlude reliably corresponds to the reference tempo. Thereafter, when the counter 158 makes the three counts of the key-ON signals KON, the tempo of the automatic performance is controlled so as to follow up the tempo of the manual performance.

Separately from the tempo return control by means of the abovementioned tempo return code detection signal TR, it is also possible to return the automatic performance tempo to the reference tempo by properly operating the tempo return instruction switch $SW_6$ so as to reset the counter 158 at an optional timing. If a self-return type push button switch is employed as the tempo return instruction switch $SW_6$ in this case, the counter 158 is reset by the ON-operation of the switch $SW_6$ and whenever three key-ON signals KON are counted, the tempo of the automatic performance is controlled so as to follow up the tempo of the manual performance. In order to prevent the rapid re-start of the tempo follow control, the T-flip-flop 220 is interposed between the switch $SW_6$ and the OR gate 166 so that the counter 158 is reset by the first ON-operation of the switch $SW_6$ and is released from resetting by the second ON-operation.

Since the averaging circuit 212 is disposed in the abovementioned embodiment so as to average the tempo data of the manual performance, it is possible to prevent the tempo of the automatic performance from following up the tempo of the manual performance too susceptively.

Although an embodiment of the present invention has been described in the foregoing, it will be obvious to those skilled in the art that various modifications and changes may be made without departing from the spirit and scope of the present invention.

I claim:

1. An automatic musical performance device having a plurality of keys, comprising:

means for generating a tempo clock signal having a frequency which determines a tempo of an automatic performance of said device;

store means for storing a set of musical note data supplied from an external recording medium for an automatic performance;

read means for sequentially reading said musical note data from said store means in accordance with said tempo clock signal;

musical tone generation means for generating musical tone signals in accordance with said musical note data read out from said store means;

data generation means for generating reference tempo data;

tempo return instruction means for generating a tempo return instruction; and tempo control means for controlling the frequency of said tempo clock signal to follow up a tempo of a manual performance effected on said keys and controlling in response to said return instruction the frequency of said tempo clock signal in accordance with said reference tempo data.

2. An automatic musical performance device having a plurality of keys, comprising:

means for generating a tempo clock signal having a frequency which determines a tempo of an automatic performance of said device;

store means for storing a set of musical note data supplied from an external recording medium for an automatic key-press indication;

read means for sequentially reading said musical note data from said store means in accordance with said tempo clock signal;

key-press indication means for indicating a specific key to be pressed among said plurality of keys in accordance with said musical note data read out from said store means;

data generation means for generating reference tempo data;

tempo return instruction means for generating a tempo return instruction; and tempo control means for controlling the frequency of said tempo clock signal to follow up a tempo of a manual performance effected on said keys and controlling in response to said return instruction the frequency of said tempo clock signal in accordance with said reference tempo data.

3. The automatic musical performance device as defined in claim 1 or 2, wherein said data generation means includes register means for storing the reference tempo data which is supplied from said recording medium.

4. The automatic musical performance device as defined in claim 1 or 2, wherein said data generation means includes means for manually setting the reference tempo data.

5. The automatic musical performance device as defined in claim 1 or 2, wherein said store means stores tempo return data supplied from said recording medium, said tempo return data being read by said read means from said store means and supplied to said tempo return instruction means for generation of said tempo return instruction.

6. The automatic musical peformance device as defined in claim 1 or 2, wherein said tempo return instruction means includes a tempo return instruction switch and generates said tempo return instruction on the basis of a manual operation of said switch.

* * * * *